US009439496B2

(12) United States Patent
Suzuki

(10) Patent No.: US 9,439,496 B2
(45) Date of Patent: Sep. 13, 2016

(54) COSMETIC CONTAINER

(71) Applicant: TOKIWA CORPORATION, Gifu (JP)

(72) Inventor: Takumi Suzuki, Saitama (JP)

(73) Assignee: TOKIWA CORPORATION, Gifu (JP)

( * ) Notice: Subject to any disclaimer, the term of this patent is extended or adjusted under 35 U.S.C. 154(b) by 66 days.

(21) Appl. No.: 14/539,257

(22) Filed: Nov. 12, 2014

(65) Prior Publication Data

US 2015/0147107 A1 May 28, 2015

(30) Foreign Application Priority Data

Nov. 26, 2013 (JP) ..... 2013-243712

(51) Int. Cl.
*A45D 33/06* (2006.01)
*A45D 33/08* (2006.01)

(52) U.S. Cl.
CPC ..... *A45D 33/06* (2013.01); *A45D 33/08* (2013.01)

(58) Field of Classification Search
CPC combination set(s) only.
See application file for complete search history.

(56) References Cited

U.S. PATENT DOCUMENTS 2,736,914 A * 3/1956 Ratliff ..... A46B 11/0013 401/194
2,867,828 A * 1/1959 Trutneff ..... A46B 11/0013 401/281
3,100,315 A * 8/1963 Laxalt ..... A45D 33/02 132/289
2010/0119287 A1 5/2010 Thorpe et al.

FOREIGN PATENT DOCUMENTS

JP 2010-110598 5/2010

* cited by examiner

*Primary Examiner* — David Walczak
(74) *Attorney, Agent, or Firm* — Greenblum & Bernstein, P.L.C.

(57) ABSTRACT

First openings and second openings are operated based on the rotation of a turning plate, thereby opening and closing the flow path for the cosmetic material. A dial portion, which serves as the operating portion of the turning plate, is provided in such a manner as to be exposed from the bottomed portion or the lateral surface in the vicinity of the bottomed portion of the container main body, and the dial portion is disposed apart from the applying portion, and when the dial portion is provided in such a manner as to be exposed from the bottomed portion, the dial portion is hidden on the bottomed portion of the container main body, so that it is unlikely that the hands of a user are soiled during the rotational operation of the dial portion.

12 Claims, 6 Drawing Sheets

COSMETIC CONTAINER

TECHNICAL FIELD

The present invention relates to a cosmetic container that applies cosmetic materials to a portion to be applied.

BACKGROUND ART

Conventionally, a dispenser disclosed in Japanese Unexamined Patent Application Publication No. 2010-110598 has been known as a device that stores powdered cosmetic materials and is used for application. The dispenser is configured such that an inner dial inclusive of an opening is fixed on the upper portion of a housing that stores the powdered cosmetic materials, and an outer dial inclusive of an opening is rotatably provided through a gasket in such a manner as to cover the inner dial from the upward and lateral directions, and the lateral surface of the outer dial is outwardly exposed on the housing, and a pipe communicated with the opening of the outer dial is longitudinally provided, and for example, an applying body such as a brush, a sponge, and a powder puff is fixed on the outer dial, and the pipe of the outer dial makes an entry into the applying body. Then, the outer dial exposed outward is held and rotated with respect to the inner dial, and the openings of the outer dial and the inner dial are communicated with each other, thereby opening a conveyance path for the powdered cosmetic material, so that the powdered cosmetic material can be provided for the applying body through the pipe. In contrast, the outer dial is rotated with respect to the inner dial to a position where the openings of the outer dial and the inner dial are not communicated with each other, thereby closing the conveyance path for the powdered cosmetic material.

CITATION LIST

Patent Literature

Patent Literature 1: Japanese Unexamined Patent Application Publication No. 2010-110598

SUMMARY OF INVENTION

Problems to be Solved by the Invention

Herein, as described above, when the conveyance path for the powdered cosmetic material is opened and closed, it is necessary to hold and rotate the outer dial with a hand. Accordingly, there is a problem in that the powdered cosmetic material adhered to the applying body comes in contact with the hand during the rotational operation, due to the presence of the applying body disposed in close proximity to the outer dial, which soils the hand.

Accordingly, it is an object of the present invention to provide a cosmetic container, which is resistant to soiling hands during a rotational operation, in which the flow path of cosmetic materials is opened and closed.

Solution to Problem

In order to solve the above-described problems, a cosmetic container according to an aspect of the present invention includes a container main body configured to store a cosmetic material and include a first opening that enables a passage of the cosmetic material, an applying portion configured to be provided in such a manner as to cover the first opening and configured to apply the cosmetic material from the container main body and a rotation portion configured to be provided in an unmovable manner in an axial direction and in a rotatable manner in a circumferential direction with respect to the container main body. The rotation portion includes a turning plate configured to be arranged in such a manner as to block the first opening from a bottomed surface side and configured to include a second opening that enables a passage of the cosmetic material an operating portion configured to perform a rotational operation of the turning plate and a shaft body configured to couple the turning plate with the operating portion. The operating portion is exposed from a bottomed portion of the container main body or a lateral surface in a vicinity of the bottomed portion of the container main body to an outside, and portions of the rotation portion, except the operating portion, are stored in the container main body, and the shaft body and the turning plate are rotated by operating the operating portion, and the first opening and the second opening are communicated with each other, thereby opening a flow path for the cosmetic material.

According to the cosmetic container, first openings provided in a container main body that stores a cosmetic material and second openings provided on a turning plate that blocks the first openings from the side of the bottomed surface are communicated with each other by means of the rotation of the turning plate, thereby opening the flow path for the cosmetic material, whereas the first openings and the second openings are not communicated with each other by means of the rotation of the turning plate, thereby closing the flow path for the cosmetic material. Thus, the operating portion of the turning plate that opens and closes the flow path is provided in such a manner as to be exposed from the bottomed portion or the lateral surface in the vicinity of the bottomed portion of the container main body, and the operating portion is disposed apart from the applying portion, and in particular, when the operating portion is provided in such a manner as to be exposed from the bottomed portion, the operating portion is hidden on the bottomed portion of the container main body, so that it is unlikely that the hands of a user are soiled during the rotational operation of the operating portion.

Herein, the container main body includes a third opening configured to connect to the first opening above the first opening, and an inclined surface configured to guide and return the cosmetic material disposed on the side of the third opening to the first opening when the container returns to a normal posture during application or after the application. Accordingly, the cosmetic material remained on the side of the third opening during the application or after the application follows the inclined surface, thereby smoothly returning to a storing chamber through the first opening.

Also, the cosmetic container further includes an intermediate frame configured to be arranged between the container main body and the applying portion and configured to be covered by the applying portion, and the intermediate frame includes an outflow path for the cosmetic material, configured to penetrate through an approximately center of the intermediate frame in the axial direction and configured to communicate with the first opening, and a concave portion configured to be depressed on an inner side or a through hole configured not to be communicated with the outflow path. Accordingly, the intermediate frame is crushed and easily deformed during the application due to the concave portion or the through hole. As a result, the applying portion easily agrees with the skin, and a sense of application can be improved.

Also, preferably, the cosmetic material is a powdered cosmetic material, and the concave portion or the through hole extends in an up-and-down direction, and a powder pool, which allows the powdered cosmetic material to make an entry through an opening of an upper portion of the concave portion or the through hole, is constituted. Also, when the above-mentioned constitution is adopted, at the time of tapping the skin during the application (powdered cosmetic material is applied in such a manner as to lightly tap the skin), the powdered cosmetic material skirts around from the tip end side of the concave portion or the through holes and makes an entry into the concave portion or the through holes. In the case of the concave portion, a powder pool in which the powdered cosmetic material is accumulated is formed in the concave portion, and in the case of the through holes, the powder pool is formed in a component arranged below the through holes, and the powder pool is also formed in the through holes subsequent to the component, so that application can be performed that covers a wide range inclusive of the concave portion or the through holes. The powdered cosmetic material discharged by compressed air generated in the course of tapping the skin is accumulated in the powder pool except the outflow path for the powdered cosmetic material, so that this enables the application that covers a wide range inclusive of the concave portion or the through holes in a more suitable manner.

Advantageous Effects of Invention

According to the embodiment of the present invention, a cosmetic container can be provided that is resistant to soiling hands during a rotational operation in which the flow path for cosmetic materials is opened and closed.

DESCRIPTION OF EMBODIMENTS

Figure 1:
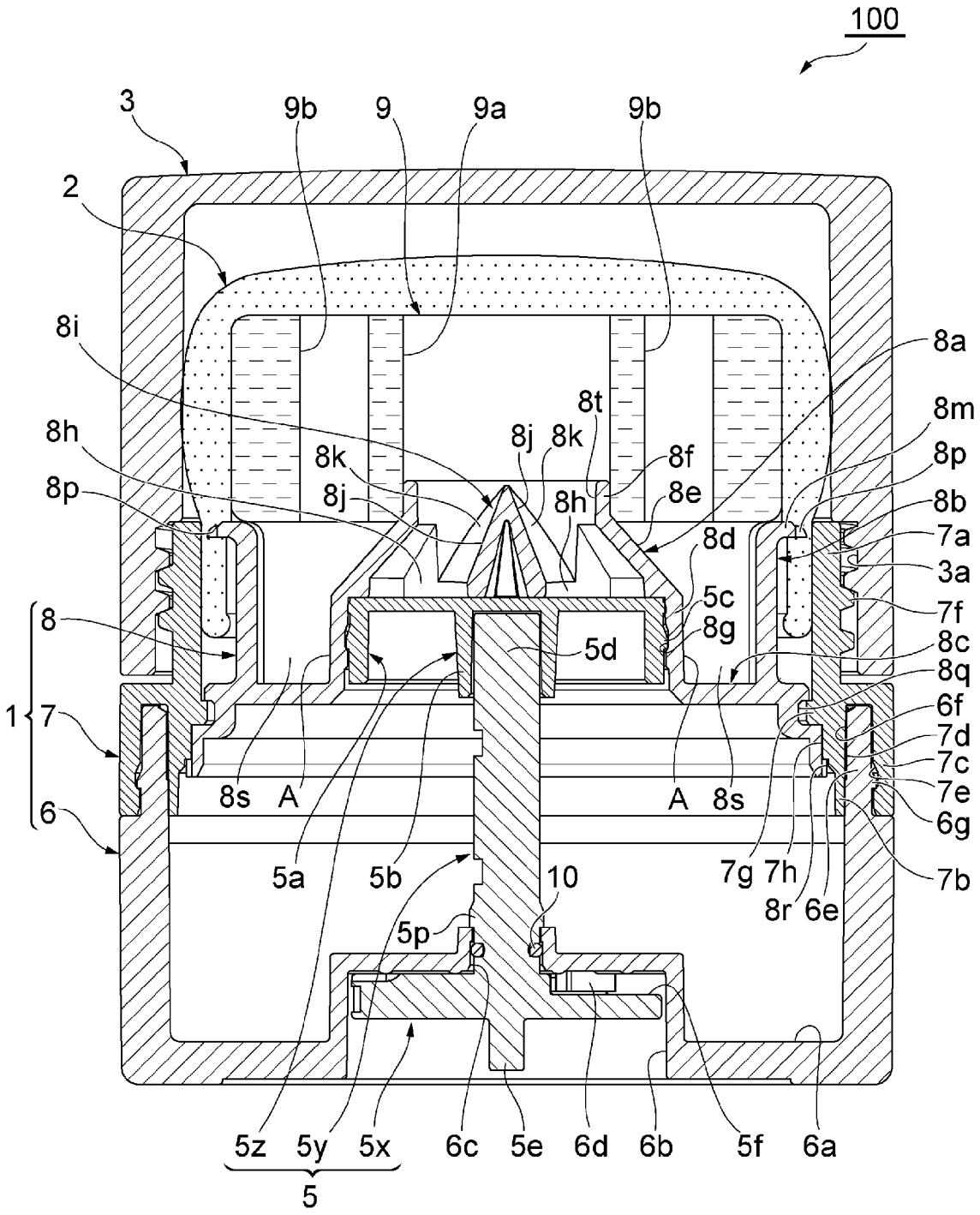
FIG. 1 is a longitudinal cross-sectional view of a cosmetic container according to the embodiment of the present invention.
Figure 2:
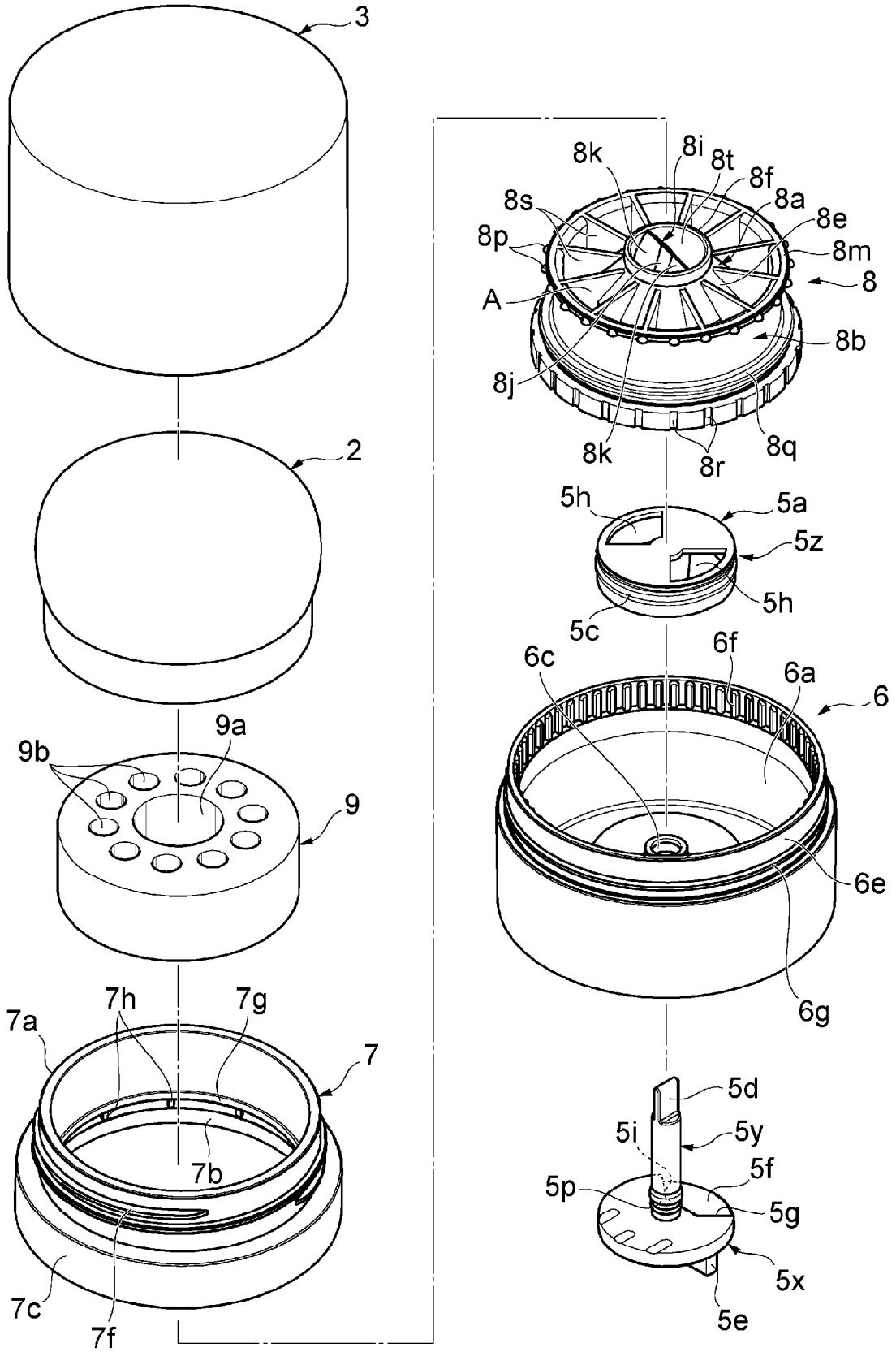
FIG. 2 is an exploded perspective view of the cosmetic container viewed from above and illustrated in FIG. 1.
Figure 3:
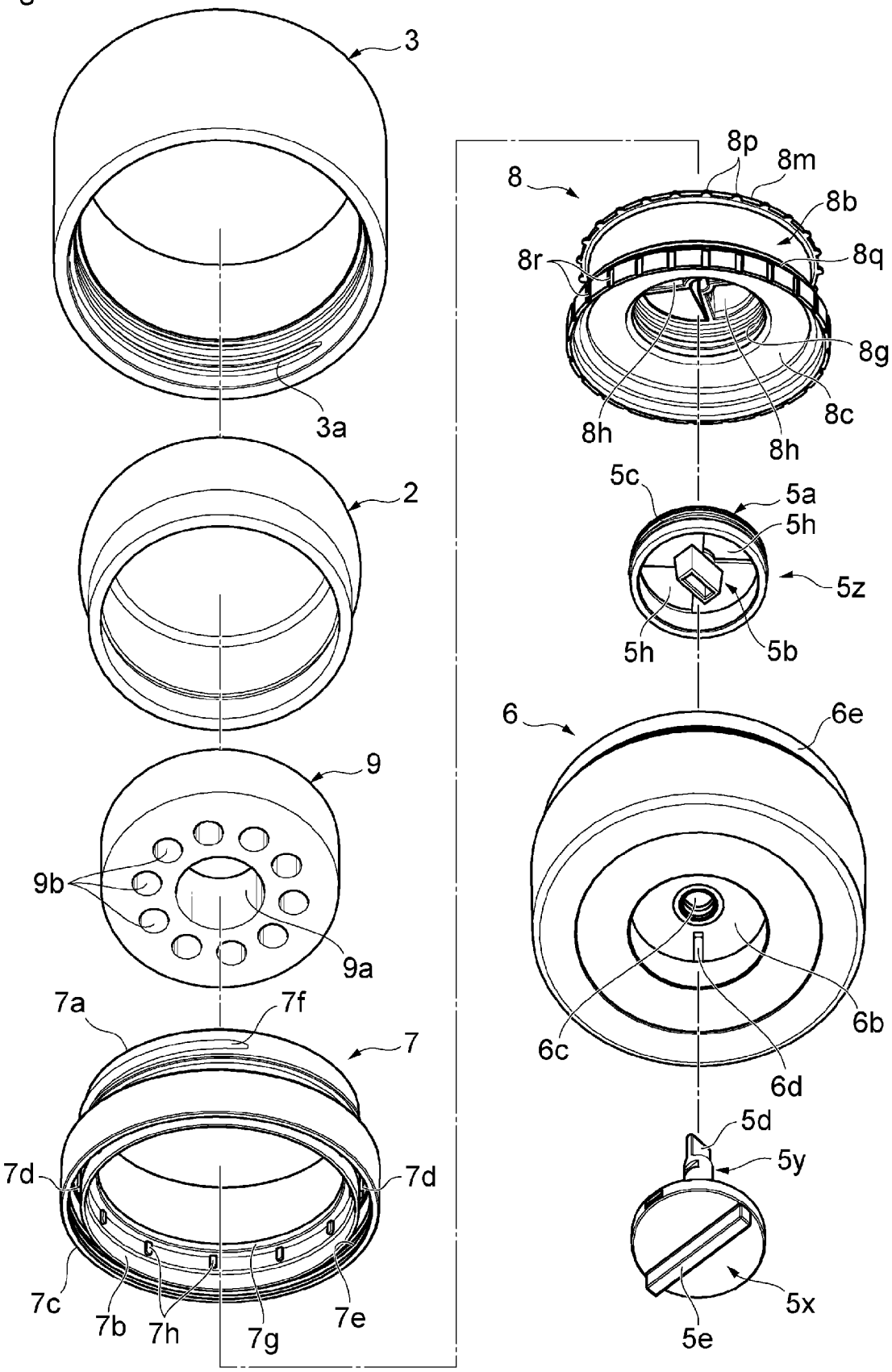
FIG. 3 is an exploded perspective view of the cosmetic container viewed from below and illustrated in FIG. 1.
Figure 4:
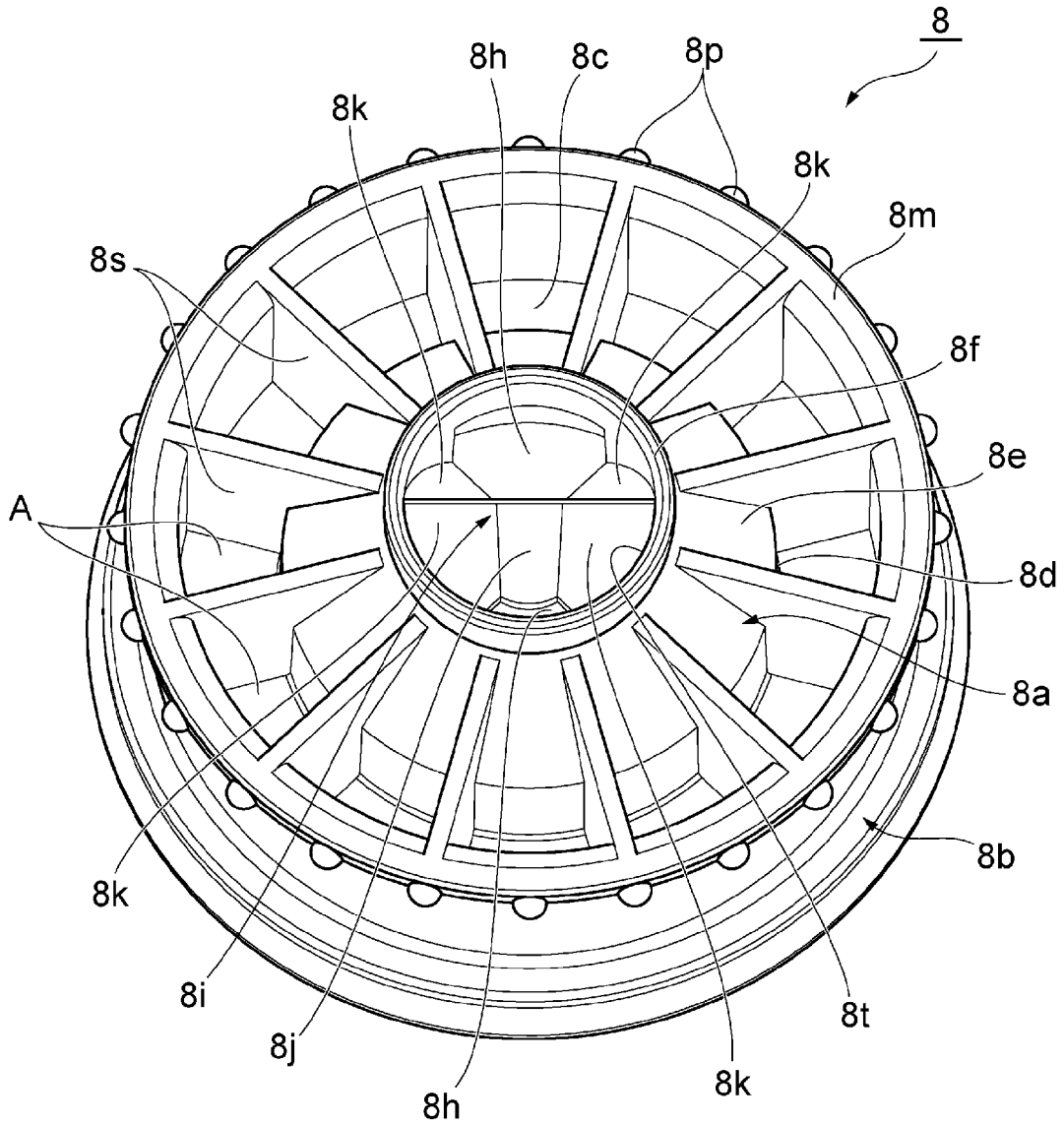
FIG. 4 is a perspective view of a base portion viewed from above and illustrated in FIGS. 1 to 3.
Figure 5:
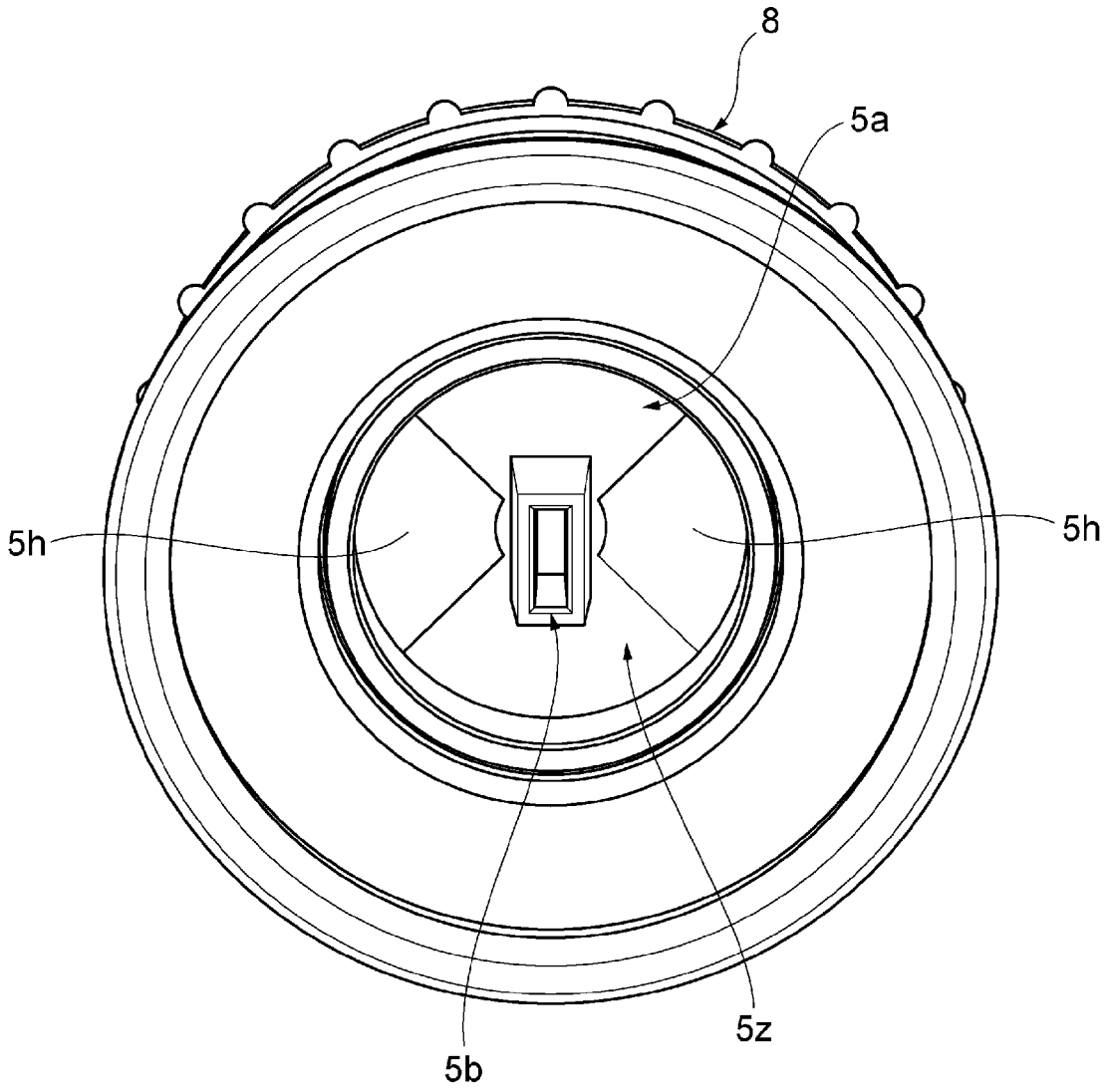
FIG. 5 is a perspective view of the base portion and a turning plate viewed from below and illustrated in FIGS. 1 to 3, and a state view representing a closed state of a valve.
Figure 6:
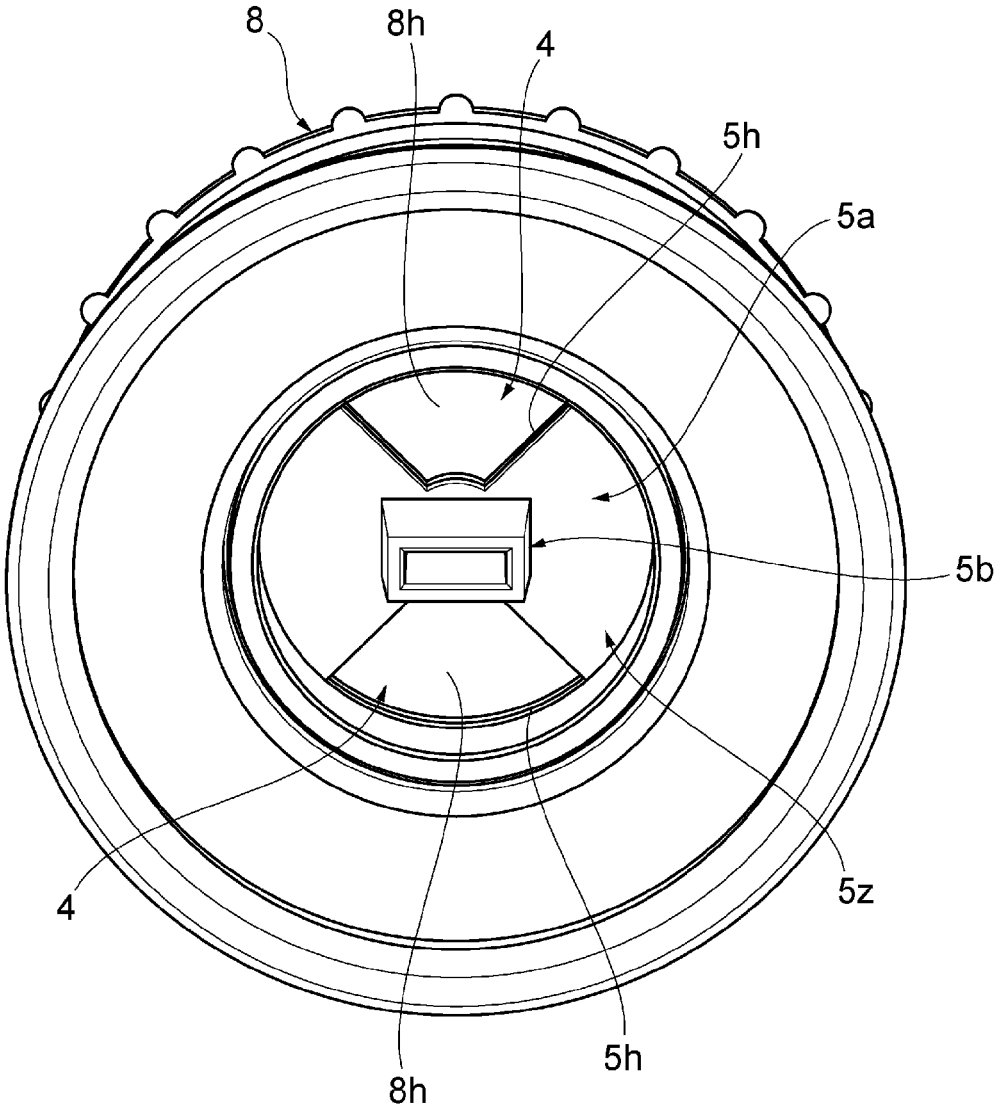
FIG. 6 is a perspective view of the base portion and the turning plate viewed from below and illustrated in FIGS. 1 to 3, and a state view representing an opened state of the valve.

Hereinafter, the preferred embodiments of a cosmetic container according to the present invention will be described referring to FIGS. 1 to 6. FIG. 1 is a longitudinal cross-sectional view of the cosmetic container according to the embodiment of the present invention. FIGS. 2 and 3 are exploded perspective views of the cosmetic container. FIG. 4 is a perspective view of a base portion viewed from above. FIGS. 5 and 6 are perspective views of the base portion and a turning plate viewed from below, which respectively represent the closed and opened states of a valve. The cosmetic container of the present embodiment, for example, is a container that is aimed at applying a powdered cosmetic material to a portion to be applied such as skin, and is particularly exemplified as a cosmetic container suitable for applying the powdered cosmetic materials to a face.

As described in FIG. 1, a cosmetic container 100 includes a container main body 1 that stores the powdered cosmetic material, an applying body 2 that is mounted on the container main body 1 and applies the powdered cosmetic material to a face, a lid portion 3 detachably mounted on the container main body 1, a flow path 4 (see FIG. 6; details are described later) that allows the powdered cosmetic material in the container main body 1 to flow to the applying body 2, and a rotation portion 5 that opens and closes the flow path 4.

In the embodiment, the powdered cosmetic material is preferably made up of loose powder. However, types of powdered cosmetic materials are not limited in a specific manner as long as they can be applicable to the present invention.

The container main body 1 includes a storage portion 6, a joint tool 7, and a base portion 8.

As illustrated in FIGS. 1 to 3, the storage portion 6, for example, is formed of resin such as Acrylonitrile Styrene (AS) and formed in a bottomed cylindrical shape. The storage portion 6 includes a storing chamber 6*a* whose bottomed cylinder stores the powdered cosmetic material. A concave portion 6*b* depressed on the inner side is formed in an approximately center of the bottomed portion of the storage portion 6 in order to arrange a later-described dial portion 5*x* of the rotation portion 5. An opening 6*c* penetrated in the axial direction is provided in an approximately center of a bottomed wall that forms the concave portion 6*b*, to which a later-described shaft body 5*y* of the rotation portion 5 is inserted. Furthermore, a stopper 6*d* having a rectangular parallelepiped shape is projectingly formed on the bottomed surface of the concave portion 6*b*, which is aimed at regulating the rotation of the dial portion 5*x*.

A projection portion 6*e* is projectingly formed upward in a cylindrical shape on the upper portion of the storage portion 6, in such a manner that the diameter of the outer circumferential surface of the upper portion is smaller than the diameter of the outer circumferential surface of the lower portion. A knurled portion 6*f*, on which projections and depressions are densely provided along the circumferential direction, is provided on the inner circumferential surface of the projection portion 6*e* so as to engage the joint tool 7 in the circumferential direction. Then, a convex portion 6*g* is provided in an annular shape on the outer circumferential surface of the projection portion 6*e* so as to engage the joint tool 7 in the axial direction.

The joint tool 7, for example, is formed of resin such as polypropylene (PP) and includes a cylindrical portion 7*a* in the upper portion thereof and an inner cylindrical portion 7*b* and an outer cylindrical portion 7*c* in the lower portion thereof. The inner cylindrical portion 7*b* of the lower portion is contiguously disposed on the lower end of the cylindrical portion 7*a* of the upper portion and extended downward. The upper end portion of the outer cylindrical portion 7*c* of the lower portion is coupled with a boundary portion between the cylindrical portion 7*a* of the upper portion and the inner cylindrical portion 7*b* of the lower portion via an annular coupling portion.

A plurality of protrusions 7*d*, which are engaged with the knurled portion 6*f* of the storage portion 6 in the circumferential direction, are provided on the outer circumferential surface of the inner cylindrical portion 7*b* of the lower portion along with the circumferential direction. A convex portion 7*g*, which is engaged with the base portion 8 in the axial direction, is provided in an annular shape on the inner circumferential surface of the upper portion of the inner cylindrical portion 7*b* of the lower portion. A plurality of protrusions 7*h*, which are engaged with the base portion 8 in the circumferential direction, are provided below the convex portion 7*g* along with the circumferential direction. A concave portion 7*e*, which is engaged with the annular convex portion 6*g* of the storage portion 6 in the axial direction, is provided in an annular shape on the inner circumferential surface of the outer cylindrical portion 7*c* of the lower portion. An external thread 7*f*, which is aimed at mounting the lid portion 3, is provided on the outer circumferential surface of the cylindrical portion 7*a* of the upper portion.

Then, as illustrated in FIG. 1, the joint tool 7 is put on the projection portion 6*e* in such a manner that the projection portion 6*e* of the storage portion 6 makes an entry into a gap between the inner cylindrical portion 7*b* and the outer cylindrical portion 7*c* of the lower portion, and the protrusions 7*d* are engaged with the knurled portion 6*f* of the storage portion 6 in the circumferential direction, and the annular concave portion 7*e* is engaged with the convex portion 6*g* of the storage portion 6 in the axial direction, thereby being unrotatably mounted on the storage portion 6 in an unmovable manner in the axial direction.

The base portion 8, for example, is formed of resin such as PP, and approximately as illustrated in FIGS. 1 to 4, is configured to connect an internal cylindrical portion 8*a* with an external cylindrical portion 8*b* on a coupling portion 8*c*.

The lower half portion of the internal cylindrical portion 8*a* is a cylindrical portion 8*d* having a cylindrical shape, and the upper half portion of the internal cylindrical portion 8*a* is represented as a cylindrical portion 8*e*, which is contiguously disposed on the upper end of the cylindrical portion 8*d* and formed in the shape of a truncated cone, whose inner and outer diameters are gradually contracted upward, and a small-diameter cylindrical portion 8*f* protruded upward is contiguously disposed on the upper end of the truncated-cone-shaped cylindrical portion 8*e*.

A concave portion 8*g* is provided in an annular shape on the inner circumferential surface of the cylindrical portion 8*d* so as to engage the turning plate 5*z* of the rotation portion 5 in the axial direction.

The cylindrical hole of the lower end portion of the truncated-cone-shaped cylindrical portion 8*e* of the internal cylindrical portion 8*a* is blocked, whereas first openings 8*h* that communicate longitudinally and allow the passage of the powdered cosmetic material are provided at an opposing position where the cylindrical portion 8*e* is detached from the turning plate 5*z* at 180 degrees in the circumferential direction. The first openings 8*h* are openings that are formed in an approximately fan shape in plan view (the section of the surface of a folding fan; hereinafter referred to as a fan shape) (see FIG. 6), and the apexes of the first openings 8*h* are oriented toward the axial center of the cylindrical portion 8*e*. A chevron-shaped portion 8*i* whose cross section is in an approximately triangular shape pointed upward is provided between the first openings 8*h*. The chevron-shaped portion 8*i* is contiguously disposed on the inner surface of the cylindrical portion 8*e* and extended in such a manner as to traverse between the first openings 8*h*.

The inclined surface of the chevron-shaped portion 8*i* includes a central inclined surface 8*j* positioned in the center and bilateral inclined surfaces 8*k*, between which the central inclined surface 8*j* is interposed, and that are contiguously disposed on the inner circumferential surface of the cylindrical portion 8*e*. The central inclined surface 8*j* and the bilateral inclined surfaces 8*k* are both provided in such a manner that their lower ends are contiguously disposed on the edge of the first openings 8*h* formed in an approximately fan shape in plan view (see FIG. 4). Specifically, the central inclined surface 8*j* is inclined in an approximately planar shape in such a manner as to orient toward an arc-shaped edge on the inner side of the fan-shaped first openings 8*h* as it goes downward. The bilateral inclined surface 8*k* is bent in such a manner as to move along with the inner circumferential surface as it goes from the central inclined surface 8*j* to the inner circumferential surface of the cylindrical portion 8*e*, and the bilateral inclined surface 8*k* is bent and inclined in such a manner as to orient toward the lateral edge of the fan-shaped first opening 8*h* it goes downward. That is, the central inclined surface 8*j* and the bilateral inclined surfaces 8*k* are inclined in such a manner as to orient toward the fan-shaped first openings 8*h*.

The cylindrical hole of the small-diameter cylindrical portion 8*f* forms a third opening 8*t* that positions above the first openings 8*h* and links with the first openings 8*h*. The small-diameter cylindrical portion 8*f* enters the lower portion of the outflow path 9*a* of an intermediate frame 9 described later, thereby positioning the intermediate frame 9 in the radial direction.

The external cylindrical portion 8*b* is formed in an approximately cylindrical shape, and a collar portion 8*m* that protrudes on the external side in the radial direction is formed in an annular shape on the upper end portion of the external cylindrical portion 8*b*. A plurality of protrusion portions 8*p* that protrude on the outer side in the radial direction and that are detached from each other are provided along with the circumferential direction on the outer circumferential surface of the collar portion 8*m* so as to engage the applying body 2. A concave portion 8*q* is provided in an annular shape on the outer circumferential surface of the lower portion of the external cylindrical portion 8*b* so as to engage the annular convex portion 7*g* of the joint tool 7 in the axial direction. Concave portions 8*r* extended in the up-and-down direction are provided below the annular concave portion 8*q* along the circumferential direction so as to engage the protrusions 7*h* of the joint tool 7 in the circumferential direction.

The coupling portion 8*c* is formed of an annular flat plate and couples the lower end of the internal cylindrical portion 8*a* with a portion on the upper side with respect to the concave portion 8*q* of the external cylindrical portion 8*b*.

Moreover, a multitude of partition plates 8*s*, which couple the outer circumferential surfaces of the cylindrical portion 8*d* and the truncated-cone-shaped cylindrical portion 8*e*, the inner circumferential surface of the external cylindrical portion 8*b*, and the upper surface of the coupling portion 8*c*, are provided along the circumferential direction between the outer circumferential surfaces of the cylindrical portion 8*d* and the truncated-cone-shaped cylindrical portion 8*e*, and the inner circumferential surface of the external cylindrical portion 8*b*. An area A surrounded by the outer circumferential surfaces of the cylindrical portion 8*d* and the truncated-cone-shaped cylindrical portion 8*e*, the inner circumferential surface of the external cylindrical portion 8*b*, and the upper surface of the coupling portion 8*c* constitutes a powder pool in which the powdered cosmetic material is accumulated.

Then, as illustrated in FIG. 1, the base portion 8 is inserted into the joint tool 7, and the concave portions 8*r* engage the protrusions 7*h* of the joint tool 7 in the circumferential direction, and the annular concave portion 8*q* engages the annular convex portion 7*g* of the joint tool 7 in the axial direction, thereby being unrotatably mounted on the joint tool 7 in an unmovable manner in the axial direction.

That is, the storage portion 6, the joint tool 7, and the base portion 8 are integrated, which constitutes the container main body 1.

The applying body 2 is configured to detach and cover the first and third openings 8*h* and 8*t* of the internal cylindrical portion 8*a* in the central portion of the base portion 8 from above and configured to extend on the outer side in the radial direction and detach and cover the first and third openings 8*h* and 8*t* from above on the outer circumferential side of the base portion 8, and the intermediate frame 9 is arranged between the applying body 2 and the base portion 8.

The intermediate frame 9 supports the applying body 2 from below. When the applying body 2 is pressed against the skin during the application, the intermediate frame 9 elastically deforms. Herein, the intermediate frame 9 is exemplified by a sponge made up of nitrile butadiene rubber (NBR) having a foaming ratio at which a sense of application is emphasized.

As illustrated in FIGS. 1 to 3, the intermediate frame 9 is constituted in a cylindrical shape having a short thickness, and the outflow path 9*a*, penetrated in the axial direction for the powdered cosmetic material to pass through, is formed as a cylindrical hole on the central portion, and a multitude of through holes 9*b* penetrated in the up-and-down direction (axial direction) are formed and positioned in such a manner that the through holes 9*b* are detached from each other at regular intervals along with the circumferential direction on the outer side in the radial direction of the outflow path 9*a*. The through holes 9*b* allow the intermediate frame 9 to easily deform and are communicated with the area A of the powder pool of the base portion 8, thereby forming another area of the powder pool above the area A.

Then, as illustrated in FIG. 1, the intermediate frame 9 is placed on the base portion 8, and the small-diameter cylindrical portion 8*f* of the base portion 8 makes an entry into the lower portion of the outflow path 9*a*, so that the first and third openings 8*h* and 8*t* of the internal cylindrical portion 8*a* of the base portion 8 communicate with the outflow path 9*a*, thereby positioning the intermediate frame 9 in the radial direction.

The applying body 2 is configured to apply the powdered cosmetic material that flows out from the outflow path 9*a* of the intermediate frame 9. As illustrated in FIGS. 1 to 3, the applying body 2 is configured to be formed in a shape of which the upper surface and the lateral surface of the intermediate frame 9 are covered in conformity of the outer surface of the intermediate frame 9. Herein, the applying body 2 is a sponge made up of urethane foam having a foaming ratio, which is suitable for the powdered cosmetic material to pass through. It is noted that the applying body 2 may be formed of the same material as that of the intermediate frame 9.

Then, as illustrated in FIG. 1, the intermediate frame 9 is covered by the applying body 2, and the protrusion portions 8*p* of the external cylindrical portion 8*b* of the base portion 8 cut into the peripheral end side of the applying body 2, and the peripheral end side of the applying body 2 is sandwiched between the protrusion portions 8*p* of the external cylindrical portion 8*b* of the base portion 8 and the cylindrical portion 7*a* of the joint tool 7, thereby mounting the applying body 2 on the container main body 1. In this state, the applying body 2 is adhered to the upper surface and the lateral surface of the intermediate frame 9, and the intermediate frame 9 is covered by the applying body 2 and held on the base portion 8.

As illustrated in FIGS. 1 to 3, the lid portion 3, for example, is formed of resin such as AS and acrylonitrile butadiene styrene (ABS) and formed in a ceilinged cylindrical shape (cylindrical shape with a top) whose top end is closed, and an internal thread 3*a* threadedly engaged with the external thread 7*f* of the joint tool 7 is provided on the inner circumferential surface of the cylindrical portion.

Then, the lid portion 3 is rotated in one direction and mounted on the joint tool 7 by threadedly engaging the internal thread 3*a* with the external thread 7*f*, whereas the lid portion 3 is rotated in the reverse direction and detached from the joint tool 7 by releasing the screw-threaded engagement.

As illustrated in FIG. 1, the rotation portion 5 includes the dial portion 5*x* as an operating portion, the turning plate 5*z*, and the shaft body 5*y* that couples the dial portion 5*x* with the turning plate 5*z*. The dial portion 5*x* is exposed to the outside from the bottomed portion of the container main body 1, and the shaft body 5*y* and the turning plate 5*z* except the dial portion 5*x* are stored in the container main body 1. The turning plate 5*z*, for example, is formed of resin such as polyethylene (PE), and the dial portion 5*x* and the shaft body 5*y*, for example, are integrally molded of resin such as PP. It is noted that the dial portion 5*x* and the shaft body 5*y* may be made up of a combination of separate components.

As illustrated in FIGS. 1 to 3, the turning plate 5*z* includes a short ceilinged cylindrical portion 5*a* whose upper end is closed and a rotation stop portion 5*b* formed on the inner surface of the ceiling portion of the ceilinged cylindrical portion 5*a*.

The ceilinged cylindrical portion 5*a* is arranged in such a manner that the ceiling portion thereof blocks the first openings 8*h* of the internal cylindrical portion 8*a* from the side of the bottomed surface. Second openings 5*h* that longitudinally communicate and allow the passage of the powdered cosmetic material are provided in the ceiling portion at an opposing position where the rotation portion 5 is detached from the base portion 8 at 180 degrees in the circumferential direction. The second openings 5*h* are openings that are formed in an approximately fan shape in plan view in such a manner that the apexes of the second openings 5*h* orient toward the axial center of the ceilinged cylindrical portion 5*a* and that are formed in an approximately same shape as those of the first openings 8*h* of the base portion 8. Also, a convex portion 5*c* engaged with the concave portion 8*g* of the cylindrical portion 8*d* of the base portion 8 in the axial direction is provided in an annular shape on the outer circumferential surface of the cylindrical portion of the ceilinged cylindrical portion 5*a*.

The rotation stop portion 5*b* serves as a rotation stop for the shaft body 5*y* and is constituted in a square cylindrical shape which is formed in a rectangular shape viewed in the axial direction. The square-cylindrical-shaped rotation stop portion 5*b* is such that the upper end thereof is closed, and the lower end thereof is opened, and the interior of the square cylinder includes a space into which the upper portion of the shaft body 5*y* makes an entry. The rotation stop portion 5*b* is arranged in such a manner as to traverse between the apexes of the fan-shaped second openings 5*h*.

Then, as illustrated in FIG. 1, the turning plate 5*z* is inserted into the cylindrical portion 8*d* of the base portion 8 and positioned in such a manner as to block the first openings 8*h* from the side of the bottomed surface, and the convex portion 5*c* of the turning plate 5*z* engages the concave portion 8*g* of the cylindrical portion 8*d* in the axial direction, thereby being mounted on the base portion 8 in a rotatable manner in the circumferential direction and in an unmovable manner in the axial direction.

As illustrated in FIGS. 1 to 3, the shaft body 5*y* is constituted in a cylindrical shape, and the cross section of the upper end portion 5*d* of the shaft body 5*y* is constituted in an approximately rectangular shape in such a manner as to make an entry into the square cylinder of the rotation stop portion 5*b* of the turning plate 5*z*. Furthermore, a bulging portion 5*p* that bulges in an annular shape in the outward radial direction is provided at an upward position with respect to the mounting position of a later-described O-ring 10 in the shaft body 5*y*.

Then, as illustrated in FIG. 1, the shaft body 5*y* is inserted into the opening 6*c* of the storage portion 6 from below, and the bulging portion 5*p* of the shaft body 5*y* is press-fitted and thrust into the storage portion 6, and the bottomed wall of the storage portion 6 is sandwiched between the bulging portion 5*p* and the dial portion 5*x*, thereby rotatably mounting the rotation portion 5 on the storage portion 6 in an unmovable manner in the axial direction. The upper end portion 5*d* of the shaft body 5*y* makes an entry into the rotation stop portion 5*b* of the turning plate 5*z*, which allows the shaft body 5*y* and the turning plate 5*z* to rotate in synchronism with each other. That is, the rotation portion 5 inclusive of the dial portion 5*x*, the shaft body 5*y*, and the turning plate 5*z* is rotatably mounted on the container main body 1 in an unmovable manner in the axial direction.

As illustrated in FIGS. 1 to 3, the dial portion 5*x* contiguously disposed on the lower end of the shaft body 5*y* is used for the rotational operation of the turning plate 5*z* and constituted in an approximately disc shape. A knob portion 5*e* for the rotational operation is provided on the bottomed surface of the dial portion 5*x* in such a manner as to protrude downward. Also, a concave portion 5*f* depressed on the side of the bottomed surface is provided on the upper surface of the dial portion 5*x* as a concave portion that stores the stopper 6*d* of the storage portion 6. The concave portion 5*f* is depressed in such a manner as to form an approximately fan shape in plan view and formed in the shape of a fan fanned out from a position near to the shaft body 5*y* to the outer circumferential edge. Fan-shaped bilateral surfaces 5*g* and 5*i* (see FIG. 2) that form the concave portion 5*f* function as a rotation stop with which the lateral surface of the stopper 6*d* of the storage portion 6 collides.

The above-described dial portion 5*x* is stored in the concave portion 6*b* of the storage portion 6, and the stopper 6*d* of the storage portion 6 is stored in the concave portion 5*f* of the dial portion 5*x*. Then, when the rotational position of the dial portion 5*x* is placed at a position where one lateral surface 5*g* of the concave portion 5*f* collides with the stopper 6*d*, the second openings 5*h* of the turning plate 5*z* are positioned below the first openings 8*h* of the base portion 8, and the first openings 8*h* and the second openings 5*h* are communicated with each other, thereby opening the flow path 4 (see FIG. 6). When the rotational position of the dial portion 5*x* is placed at a position where the other lateral surface 5*i* of the concave portion 5*f* collides with the stopper 6*d*, a portion interposed between the second openings 5*h* of the turning plate 5*z* is positioned below the first openings 8*h* of the base portion 8, and the first openings 8*h* and the second openings 5*h* are not communicated with each other, thereby closing the flow path 4 (see FIG. 5).

It is noted that the marks indicative of an opening position and a closing position of the flow path 4 by means of the dial portion 5*x* are provided in the neighborhood of the concave portion 6*b* of the storage portion 6 and in the close vicinity of the dial portion 5*x*.

Also, the O-ring 10 for maintaining air tightness is arranged between the opening 6*f* of the bottomed wall, which forms the concave portion 6*b* of the storage portion 6, and the shaft body 5*f* of the rotation portion 5.

Subsequently, the action of the cosmetic container 100 having the above-mentioned constitution will be described. First, the closed state of the flow path 4 will be described (see FIG. 1), wherein the lid portion 3 is mounted on the container main body 1, the other lateral surface 5*f* of the concave portion 5*f* of the dial portion 5*x* is brought into close contact with the stopper 6*d* of the storage portion 6, and the first openings 8*h* and the second openings 5*h* are not communicated with each other (see FIG. 5).

When the cosmetic container 100 is used in the above-mentioned state, a user removes the lid portion 3 from the container main body 1 and subsequently pinches the knob portion 5*e* of the dial portion 5*x* so as to enable the application of the powdered cosmetic material, and rotates the knob portion 5*e* in the opening direction until the dial portion 5*x* comes to a stop. Then, one lateral surface 5*g* of the concave portion 5*f* of the dial portion 5*x* is brought into close contact with the stopper 6*d* of the storage portion 6, which allows the first openings 8*h* and the second openings 5*h* to communicate with each other (see FIG. 6), thereby opening the flow path 4.

At this time, the dial portion 5*x*, for which the rotational operation is performed, is disposed apart from the applying body 2 and hidden on the bottomed portion of the container main body 1, so that it is unlikely that the powdered cosmetic material of the applying body 2 adheres to the hands of the user.

In the above-mentioned state, while tilting the container main body 1, the user presses the applying body 2 to the skin and taps the skin with the applying body 2. Then, the powdered cosmetic material in the storing chamber 6*a* passes through the flow path 4 (the second openings 5*h*, the first openings 8*h*, and the third opening 8*t*) and the outflow path 9*a* of the intermediate frame 9 and flows out into the applying body 2, so that the powdered cosmetic material can be applied through the applying body 2.

Regarding the application, the applying body 2 is pressed against the skin, so that the through holes 9*b* provided in the intermediate frame 9 are crushed, which deforms the intermediate frame 9. As a result, the applying body 2 agrees with the skin, which improves the sense of application. It is noted that the number of through holes 9*b* or their size may be arbitrarily set, which makes it possible to appropriately adjust hardness.

Herein, at the time of tapping the skin during the application, the powdered cosmetic material skirts around from the tip end side of the through holes 9*b* and makes an entry into the through holes 9*b* and is accumulated in the area A of the powder pool of the base portion 8. When the powdered cosmetic material is large in quantity, the powdered cosmetic material is accumulated in the through holes 9*b*. Accordingly, during the application, besides the outflow path 9*a*, the powdered cosmetic material flows out from a multitude of through holes 9*b* that surround the outflow path 9*a*, which enables the application that covers a wide range inclusive of the through holes 9*b*.

Also, at the time of tapping the skin in the above-mentioned manner, the powdered cosmetic material is discharged by compressed air that is generated in the outflow path 9*a* in the course of tapping the skin. Besides the outflow path 9*a*, the powdered cosmetic material is discharged from a multitude of through holes 9*b* (powder pool) that surround the outflow path 9*a*, by means of the compressed air generated in the course of tapping the skin. Accordingly, this enables the application that covers a wide range inclusive of the through holes 9*b* in a more suitable manner. It is noted that the compressed air is varied in accordance with the magnitude of outflow path 9*a* or the magnitude or the number of through holes 9*b*, so that a discharging state can be set to a proper degree.

Then, when the container main body 1 is returned to a normal posture (erect posture illustrated in FIG. 1) during the application or after the application, the powdered cosmetic material remained on the side of the third opening 8*t* of the base portion 8 follows the central inclined surface 8*j* that is inclined in such a manner as to orient toward the first openings 8*h* of the base portion 8, and the bilateral inclined surfaces 8*k*, and the powdered cosmetic material is smoothly guided to the first openings 8*h* and smoothly returned to the storing chamber 6*a* further through the second openings 5*h*.

When the use of the cosmetic container 100 is completed, the user pinches the knob portion 5*e* of the dial portion 5*x* and rotates the dial portion 5*x* in the reverse direction with respect to the above-mentioned direction until the dial portion 5*x* comes to a stop. Then, the other lateral surface 5*i* of the concave portion 5*f* of the dial portion 5*x* is brought into close contact with the stopper 6*d* of the storage portion 6, so that the first openings 8*h* and the second openings 5*h* are not communicated with each other, thereby closing the flow path 4 (see FIG. 5).

Then, as is the same case where the flow path 4 is opened, it is unlikely that the powdered cosmetic material of the applying body 2 adheres to the hands of the user during the rotational operation of the dial portion 5*x*.

Subsequently, the user mounts the lid portion 3 on the container main body 1 and completes the use of the cosmetic container 100.

Thus, in the present invention, the dial portion 5*x*, which serves as the operating portion of the turning plate 5*z* that opens and closes the flow path 4, is provided in such a manner as to be exposed from the bottomed portion of the container main body 1, and the dial portion 5*x* is disposed apart from the applying body 2 and hidden on the bottomed portion of the container main body 1, so that it is unlikely that the hands of the user are soiled during the rotational operation of the dial portion 5*x*.

It is noted that, in the present invention, the flow path 4 is opened and closed by means of the dial portion 5*x* in a state where the lid portion 3 is removed, in order to prevent the dispersion or dissipation of the powdered cosmetic material no matter how small it is. However, it is possible to open and close the flow path 4 by means of the dial portion 5*x* in a state where the lid portion 3 is mounted. In this case, the lid portion 3 is mounted, so that the hands of the user are not soiled during the rotational operation of the dial portion 5*x*.

Also, the dial portion 5*x* not only completely opens and closes the flow path 4, but also locates itself at an arbitrary position between the opening position and the closing position, so that the flow path 4 with an opening of a desired magnitude can be formed, and the desired volume of powdered cosmetic materials can be applied.

Incidentally, the dispenser in Japanese Unexamined Patent Application Publication No. 2010-110598 described at Background Art has a constitution in which a pipe, which is a conveyance path for the powdered cosmetic material, makes an entry into the applying body, so that it is hard for the applying body to deform during the application due to the internal rigid pipe. Consequently, there is a problem in that it is hard for the powdered cosmetic material to agree with the skin, and a sufficient sense of application cannot be provided. In the present embodiment, the intermediate frame 9 is crushed due to the through holes 9*b* during the application, which makes it easy for the applying body 2 to deform, so that the powdered cosmetic material can easily agree with the skin, and the improvement of the sense of application can be achieved, which has been long wished in recent years.

Accordingly, the present invention has been specifically described based on the embodiment. However, the present invention is not limited to the present embodiment. For example, in the above-mentioned present embodiment, the through holes 9*b* extended in the up-and-down direction are provided in the intermediate frame 9, in order to easily deform the intermediate frame 9. However, the through holes 9*b* may be extended in another direction except the up-and-down direction as long as the through holes 9*b* are not communicated with the outflow path 9*a*. Also, the concave portion depressed on the inner side may be used in place of the through holes 9*b*. The concave portion is not limited to the concave portion opened upward (concave portion provided on the upper surface), but the concave portion opened laterally (concave portion provided on the lateral surface) may be applied. The above-mentioned concave portion can also facilitate the deformation of the intermediate frame 9.

Also, in the present embodiment, the powder pool that the powdered cosmetic material can enter is constituted by the through holes 9*b* extended in the up-and-down direction of the intermediate frame 9. However, when the through holes 9*b* extended in the up-and-down direction are replaced with the concave portion, the powder pool can be similarly constituted. Even when the above-mentioned constitution is applied, as is the same case with the through holes 9*b*, the application that covers a wide range inclusive of the concave portion can be performed, and the powdered cosmetic material discharged by the compressed air generated in the course of tapping the skin can be extended in the wide range inclusive of the concave portion. Also, when the lower end of the through holes 9*b* is blocked by means of another member, the powder pool can be constituted.

It is noted that constitution, in which the intermediate frame 9 and the applying body 2 are not included, is conceivable. In this case, for example, it may be such that the third opening 8*t* of the base portion 8, which is an opening from which the powdered cosmetic material flows out, is closed, and a multitude of small holes are opened in the closed portion, thereby providing an applying portion integrated (integrally formed) with the base portion 8. Preferably, the applying portion is increased in size in the radial direction in such a manner as to enable the application that covers a wide range.

Also, in the present embodiment, the storage portion 6, the joint tool 7, and the base portion 8 are provided as separate members constituting the container main body 1. However, the container main body 1 may be constituted by integrating the storage portion 6 with the joint tool 7, or by integrating the joint tool 7 with the base portion 8, or by integrating the storage portion 6, the joint tool 7, and the base portion 8.

Also, in the present embodiment, the operating portion of the turning plate 5*z* is provided as the dial portion 5*x*. However, for example, the operating portion may be formed in protruded shapes such as a rod shape, a flat-plate shape, and a spherical shape, besides the dial portion 5*x*. Except for the bottomed portion, a place where the operating portion is exposed to the outside of the container main body 1 may be a lateral surface in the vicinity of the bottomed portion. Also, the operating portion exposed to the lateral surface of the container main body 1 may be replaced with, for example, a ring-shaped operating portion exposed in such a manner as to surround the entire circumference of the lateral surface or an arc-shaped operating portion exposed in such a manner as to be situated along the part of the lateral surface. Furthermore, the operating portion may be provided as a gear of dial type and constituted in such a manner that part of the gear is exposed from the lateral surface of the container main body 1 to the outside. Even when any of these constitutions is applied, the operating portion is disposed apart from the applying portion, so that it is unlikely that the hands of the user are soiled by the powdered cosmetic material during the rotational operation in which the flow path 4 is opened and closed, compared with the conventional technologies.

Moreover, in the present embodiment, the cosmetic material is exemplified by the powdered cosmetic material, in particular, as the preferred embodiment, but a liquid cosmetic material is also applicable in the present embodiment.

What is claimed is:

1. A cosmetic container comprising:

a container main body configured to store a cosmetic material and including a first opening that enables a passage of the cosmetic material;

an applying portion covering the first opening and configured to apply the cosmetic material from the container main body; and a rotation portion provided in an unmovable manner in an axial direction and in a rotatable manner in a circumferential direction with respect to the container main body, wherein the rotation portion further includes:

a turning plate arranged to block the first opening from a bottomed surface side and including a second opening that enables a passage of the cosmetic material, the second opening having substantially the same shape as the first opening;

an operating portion configured to perform a rotational operation of the turning plate; and a shaft body configured to couple the turning plate with the operating portion, and wherein the operating portion is exposed from a bottomed portion of the container main body or a lateral surface in a vicinity of the bottomed portion of the container main body to an outside, and portions of the rotation portion, except the operating portion, are stored in the container main body, and wherein the shaft body and the turning plate are rotated by operating the operating portion, and the first opening and the second opening are communicated with each other, thereby opening a flow path for the cosmetic material.

2. The cosmetic container according to claim 1, wherein the container main body further includes:

a third opening configured to connect to the first opening above the first opening; and an inclined surface configured to guide and return the cosmetic material disposed on a side of the third opening to the first opening when the container returns to a normal posture during application or after the application.

3. The cosmetic container according to claim 2, further comprising an intermediate frame configured to be arranged between the container main body and the applying portion and configured to be covered by the applying portion, wherein the intermediate frame further includes:

an outflow path for the cosmetic material, configured to penetrate through an approximately center of the intermediate frame in an axial direction and configured to communicate with the first opening; and a concave portion configured to be depressed on an inner side or a through hole configured not to be communicated with the outflow path.

4. The cosmetic container according to claim 3, wherein the cosmetic material is a powdered cosmetic material, the concave portion or the through hole extends in an up-and-down direction, and a powder pool, which allows the powdered cosmetic material to make an entry through an opening of an upper portion of the concave portion or the through hole, is constituted.

5. The cosmetic container according to claim 1, further comprising an intermediate frame configured to be arranged between the container main body and the applying portion and configured to be covered by the applying portion, wherein the intermediate frame further includes:

an outflow path for the cosmetic material, configured to penetrate through an approximately center of the intermediate frame in an axial direction and configured to communicate with the first opening; and a concave portion configured to be depressed on an inner side or a through hole configured not to be communicated with the outflow path.

6. The cosmetic container according to claim 5, wherein the cosmetic material is a powdered cosmetic material, the concave portion or the through hole extends in an up-and-down direction, and a powder pool, which allows the powdered cosmetic material to make an entry through an opening of an upper portion of the concave portion or the through hole, is constituted.

7. A cosmetic container comprising:

a container main body configured to store a cosmetic material and include a first opening that enables a passage of the cosmetic material;

an applying portion configured to be provided in such a manner as to cover the first opening and configured to apply the cosmetic material from the container main body; and a rotation portion configured to be provided in an unmovable manner in an axial direction and in a rotatable manner in a circumferential direction with respect to the container main body, wherein the rotation portion further includes:

a turning plate configured to be arranged in such a manner as to block the first opening from a bottomed surface side and configured to include a second opening that enables a passage of the cosmetic material;

an operating portion configured to perform a rotational operation of the turning plate; and a shaft body configured to couple the turning plate with the operating portion, and wherein the operating portion is exposed from a bottomed portion of the container main body or a lateral surface in a vicinity of the bottomed portion of the container main body to an outside, and portions of the rotation portion, except the operating portion, are stored in the container main body, wherein the shaft body and the turning plate are rotated by operating the operating portion, and the first opening and the second opening are communicated with each other, thereby opening a flow path for the cosmetic material, and wherein the container main body further includes:

a third opening configured to connect to the first opening above the first opening; and an inclined surface configured to guide and return the cosmetic material disposed on a side of the third opening to the first opening when the container returns to a normal posture during application or after the application.

8. The cosmetic container according to claim 7, further comprising an intermediate frame configured to be arranged between the container main body and the applying portion and configured to be covered by the applying portion, wherein the intermediate frame further includes:

an outflow path for the cosmetic material, configured to penetrate through an approximately center of the intermediate frame in an axial direction and configured to communicate with the first opening; and a concave portion configured to be depressed on an inner side or a through hole configured not to be communicated with the outflow path.

9. The cosmetic container according to claim 8, wherein the cosmetic material is a powdered cosmetic material, the concave portion or the through hole extends in an up-and-down direction, and a powder pool, which allows the powdered cosmetic material to make an entry through an opening of an upper portion of the concave portion or the through hole, is constituted.

10. A cosmetic container comprising:

a container main body configured to store a cosmetic material and include a first opening that enables a passage of the cosmetic material;

an applying portion configured to be provided in such a manner as to cover the first opening and configured to apply the cosmetic material from the container main body; and a rotation portion configured to be provided in an unmovable manner in an axial direction and in a rotatable manner in a circumferential direction with respect to the container main body, wherein the rotation portion further includes:

a turning plate configured to be arranged in such a manner as to block the first opening from a bottomed surface side and configured to include a second opening that enables a passage of the cosmetic material;

an operating portion configured to perform a rotational operation of the turning plate; and a shaft body configured to couple the turning plate with the operating portion, and wherein the operating portion is exposed from a bottomed portion of the container main body or a lateral surface in a vicinity of the bottomed portion of the container main body to an outside, and portions of the rotation portion, except the operating portion, are stored in the container main body, wherein the shaft body and the turning plate are rotated by operating the operating portion, and the first opening and the second opening are communicated with each other, thereby opening a flow path for the cosmetic material; and further comprising an intermediate frame configured to be arranged between the container main body and the applying portion and configured to be covered by the applying portion, wherein the intermediate frame further includes:

an outflow path for the cosmetic material, configured to penetrate through an approximately center of the intermediate frame in an axial direction and configured to communicate with the first opening; and a concave portion configured to be depressed on an inner side or a through hole configured not to be communicated with the outflow path.

11. The cosmetic container according to claim 10, wherein the cosmetic material is a powdered cosmetic material, the concave portion or the through hole extends in an up-and-down direction, and a powder pool, which allows the powdered cosmetic material to make an entry through an opening of an upper portion of the concave portion or the through hole, is constituted.

12. The cosmetic container according to claim 1, wherein the first opening and the second opening are fan shaped.

* * * * *